US008864193B2

(12) United States Patent
Mori et al.

(10) Patent No.: US 8,864,193 B2
(45) Date of Patent: Oct. 21, 2014

(54) VEHICLE DOOR INNER HANDLE CABLE CONNECTION

(75) Inventors: Masatoshi Mori, Columbus, OH (US); Charles Griever, Jr., Springfield, OH (US); Robert Bator, Marysville, OH (US); Benjamin Huttsell, Dublin, OH (US); Kozo Kusumoto, Dublin, OH (US)

(73) Assignee: Honda Motor Co., Ltd., Tokyo (JP)

( * ) Notice: Subject to any disclaimer, the term of this patent is extended or adjusted under 35 U.S.C. 154(b) by 133 days.

(21) Appl. No.: 13/206,997

(22) Filed: Aug. 10, 2011

(65) Prior Publication Data

US 2013/0038074 A1 Feb. 14, 2013

(51) Int. Cl.
*E05B 3/00* (2006.01)
*E05B 79/20* (2014.01)
*E05B 85/12* (2014.01)

(52) U.S. Cl.
CPC ..... *E05B 79/20* (2013.01); *E05B 85/12* (2013.01); *Y10S 292/30* (2013.01); *Y10S 292/53* (2013.01); *Y10S 292/54* (2013.01)
USPC ..... 292/336.3; 292/DIG. 30; 292/DIG. 53; 292/DIG. 54

(58) Field of Classification Search
CPC ..... E05B 79/06; E05B 15/02; E05B 3/06
USPC ..... 292/336.3, 256, 256.6, 80, DIG. 38, 292/300, 303, 304, 305, 306, DIG. 30, 292/DIG. 53, DIG. 54, DIG. 64, 347; 16/207, 16/209
See application file for complete search history.

(56) References Cited

U.S. PATENT DOCUMENTS

| | | | | |
|---|---|---|---|---|
| 2,486,565 | A * | 11/1949 | Kojan et al. | 292/256 |
| 3,954,238 | A | 5/1976 | Nivet | |
| 5,011,202 | A * | 4/1991 | Kato et al. | 292/336.3 |
| 6,152,501 | A * | 11/2000 | Magi et al. | 292/336.3 |
| 6,167,779 | B1 * | 1/2001 | Sano et al. | 74/543 |
| 6,976,717 | B2 * | 12/2005 | Barr et al. | 292/336.3 |
| 6,988,752 | B2 * | 1/2006 | Belchine et al. | 292/336.3 |

(Continued)

FOREIGN PATENT DOCUMENTS

| | | | |
|---|---|---|---|
| JP | 54159924 | A * | 12/1979 |
| JP | 2003041829 | | 2/2003 |
| JP | 2006336695 | | 12/2006 |

*Primary Examiner* — Kristina Fulton
*Assistant Examiner* — Faria Ahmad
(74) *Attorney, Agent, or Firm* — Rankin, Hill & Clark LLP

(57) ABSTRACT

A vehicle door handle device for attaching to a door panel for operating a door latching device and a door locking device comprises an operation handle and a lock knob. The operation handle operates the latching device to unlatch and open the door. The lock knob operates the locking device to lock and unlock the door. An open cable links the operation handle to the latching device. A lock cable links the lock knob to the locking device. An inner handle housing houses the operation handle and the lock knob. The handle housing includes a cable support part defining a first space for receiving an end portion of the open cable, and a second space for receiving an end portion of the lock cable. The cable support part is configured to prevent one of the end portion of the open cable and the end portion of the lock cable from being received in one of the first space and the second space.

17 Claims, 4 Drawing Sheets

(56) References Cited

U.S. PATENT DOCUMENTS

| | | | | |
|---|---|---|---|---|
| 7,029,042 | B2 * | 4/2006 | Belchine, III | 292/336.3 |
| 7,367,855 | B2 | 5/2008 | Iwakami et al. | |
| 7,387,282 | B2 * | 6/2008 | Kovac | 248/74.4 |
| 7,464,966 | B2 | 12/2008 | Miyajima et al. | |
| 7,527,307 | B2 * | 5/2009 | Belchine et al. | 292/336.3 |
| 7,770,850 | B2 | 8/2010 | Allmann et al. | |
| 2001/0045752 | A1 * | 11/2001 | Predd et al. | 292/336.3 |
| 2002/0008389 | A1 * | 1/2002 | Nomura et al. | 292/336.3 |
| 2010/0171325 | A1 | 7/2010 | Takagai et al. | |
| 2011/0175377 | A1 * | 7/2011 | Tanaka et al. | 292/336.3 |

* cited by examiner

VEHICLE DOOR INNER HANDLE CABLE CONNECTION

BACKGROUND

Exemplary embodiments herein generally relate to vehicle door, and, more particularly, relate to an inner handle cable connection for a vehicle door handle device.

A vehicle door handle device is used to operate a latching and locking device to unlock and open a door from a vehicle body. The handle device is typically attached to a door panel. There are two kinds of such handle devices, an inside door handle device and an outer side door handle device. In an inside door handle device, the door is opened by operating an operation handle in the passenger compartment. In an outer side door handle device, the door is opened by operating an operation handle on the vehicle exterior. In either device, operative force is transmitted to the latching/locking device by at least one cable or rod when the operation handle is actuated. As a result, the locked state of the door maintained by the locking device is released.

Handle devices may include a lock knob attached to a lock cable and a lever attached to an open cable. The lock cable and open cable are generally secured to the housing of the door handle device. According to one known configuration, a separate bracket is secured to the housing. The bracket is provided with a pair of openings or recesses dimensioned to receive grooved portions located on end portions of the respective lock cable and the open cable. Each cable is secured to the separate bracket via a separate mounting device or clip that is mounted on the bracket via a conventional fastener. The lock cable and open cable are then attached to a respective lock knob and lever or grip provided on the handle device. According to another known configuration, in lieu of the separate bracket, the housing includes a pair of recesses dimensioned to receive the grooved portions of the respective lock cable and open cable. A pair of mounting devices or clips is secured to the housing via conventional fasteners. Each mounting device is configured to securely receive one of the lock cable and the open cable.

With the above conventional designs for connecting the lock cable and open cable to the housing of the handle device, separate mounting devices are required. With these mounting devices, cable drop-off can occur. Further, because the end portions of the lock cable and open cable are similarly shaped and dimensioned, during assembly of the door handle device, a worker inadvertently can cross the cables, and thereby attach the lock cable to the mounting device intended for the open cable and the open cable to the mounting device intended for the lock cable. This can result in the lock cable being connected to the grip and the open cable being connected to the lock knob.

BRIEF DESCRIPTION

In accordance with one aspect, a vehicle door handle device for attaching to a door panel for operating a door latching device and a door locking device comprises an operation handle and a lock knob. The operation handle operates the latching device to unlatch and open the door. The lock knob operates the locking device to lock and unlock the door. An open cable links the operation handle to the latching device. A lock cable links the lock knob to the locking device. An inner handle housing houses the operation handle and the lock knob. The handle housing includes a cable support part defining a first space for receiving an end portion of the open cable, and a second space for receiving an end portion of the lock cable. The cable support part is configured to prevent one of the end portion of the open cable and the end portion of the lock cable from being received in one of the first space and the second space.

In accordance with another aspect, a vehicle door handle device adapted to be attached to a door panel for operating a locking device to unlock a door from a vehicle body comprises an operation handle for operating the locking device to perform an unlocking action. An open cable and a lock cable link the operation handle to the locking device and transmit an operative force of the operation handle to the locking device. An inner handle housing integrates the operation handle and respective end portions of both the open cable and the locking cable. The handle housing includes an integral cable support part for supporting the respective end portions of the open cable and the locking cable. The cable support part includes a first side wall and a second side wall which is offset from the first side wall. The first and second side walls are configured to define first and second portions of the cable support part. The first portion has a first configuration for receiving the end portion of the open cable and the second portion has a second configuration for receiving the end portion of the lock cable. At least one of the first configuration and the second configuration is too small to receive at least one of the end portion of the open cable and the end portion of the lock cable.

In accordance with yet another aspect, a method of securing an open cable and a lock cable to an inner handle housing of a vehicle door handle device is provided. The door handle device is adapted to be attached to a door panel for operating a door latching device and a door locking device. The method comprises providing a cable support part on the inner handle housing for supporting respective end portions of the open cable and the lock cable. The cable support part includes a first portion having a first configuration and a second portion have a second configuration different than the first configuration. A first elongated member is fixed on the end portion of the open cable. A second elongated member is fixed on the end portion of the lock cable. The method further comprises mounting the first elongated member on the first portion of the cable support part, and mounting the second elongated member on the second portion of the cable support part.

DETAILED DESCRIPTION

It should, of course, be understood that the description and drawings herein are merely illustrative and that various modifications and changes can be made in the structures disclosed without departing from the present disclosure. It will also be appreciated that the various identified components of the exemplary inner handle cable connection for a vehicle door disclosed herein are merely terms of art that may vary from one manufacturer to another and should not be deemed to limit the present disclosure.

Figure 1:
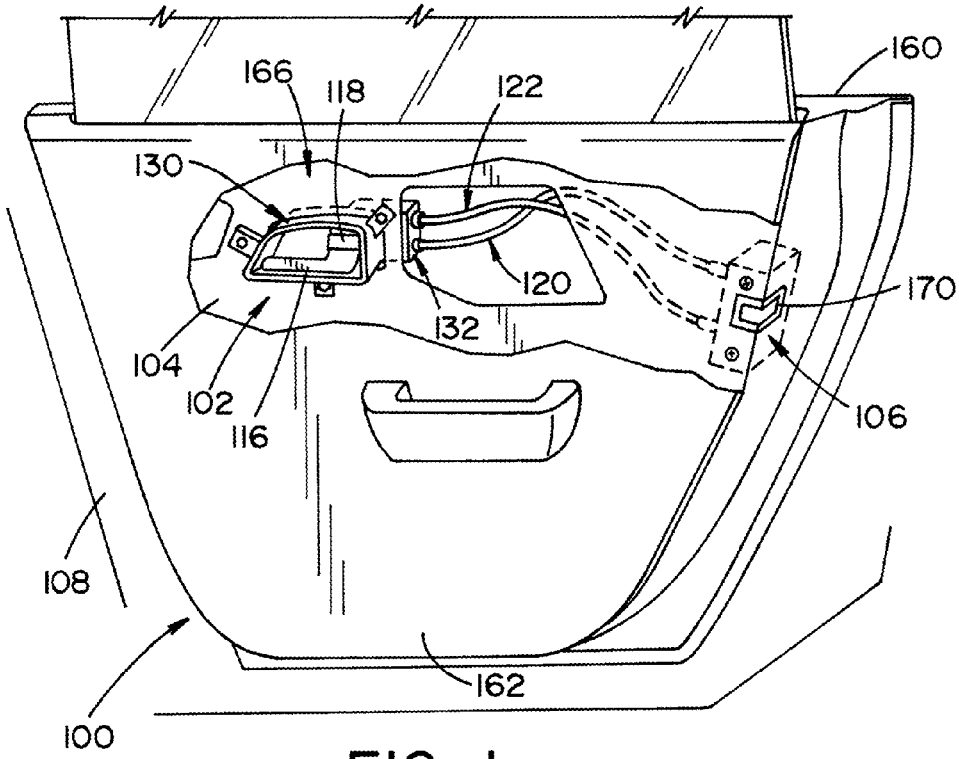
FIG. 1 schematically illustrates an exemplary vehicle door handle device adapted to be attached to a door panel for operating a locking device to unlock a door from a vehicle body.

Referring now to the drawings, wherein like numerals refer to like parts throughout the several views, FIG. 1 schematically illustrates a vehicle door 100 including an exemplary door handle device 102 adapted to be attached to a door panel 104 for operating a door latching device and a locking device (the latching and locking devices are shown together at reference numeral 106; although, it should be appreciated that the latching device can be separate from the locking device). The door 100 is attached in an openable and closable manner to a vehicle body 108 (only a portion of which is shown). In the illustrated embodiment, the door handle device 102 comprises an operation handle 116 for operating the latching device to unlatch and open the door 100 and a lock knob 118 for operating the locking device to lock and unlock the door 100. As shown, the operation handle 116 and lock knob 118 are separate actuators that can act independently from one another; although, it should be appreciated that the operation handle can be configured to unlock as well as open the door 100. An open cable 120 links the operation handle 116 to the latching device and transmits an operative force of the operation handle 116 to the latching device. A lock cable 122 links the lock knob 118 to the locking device and transmits an operative force of the operation handle 116 to the locking device. An inner handle housing 130 receives the operation handle 116 and lock knob 118.

Figure 2:
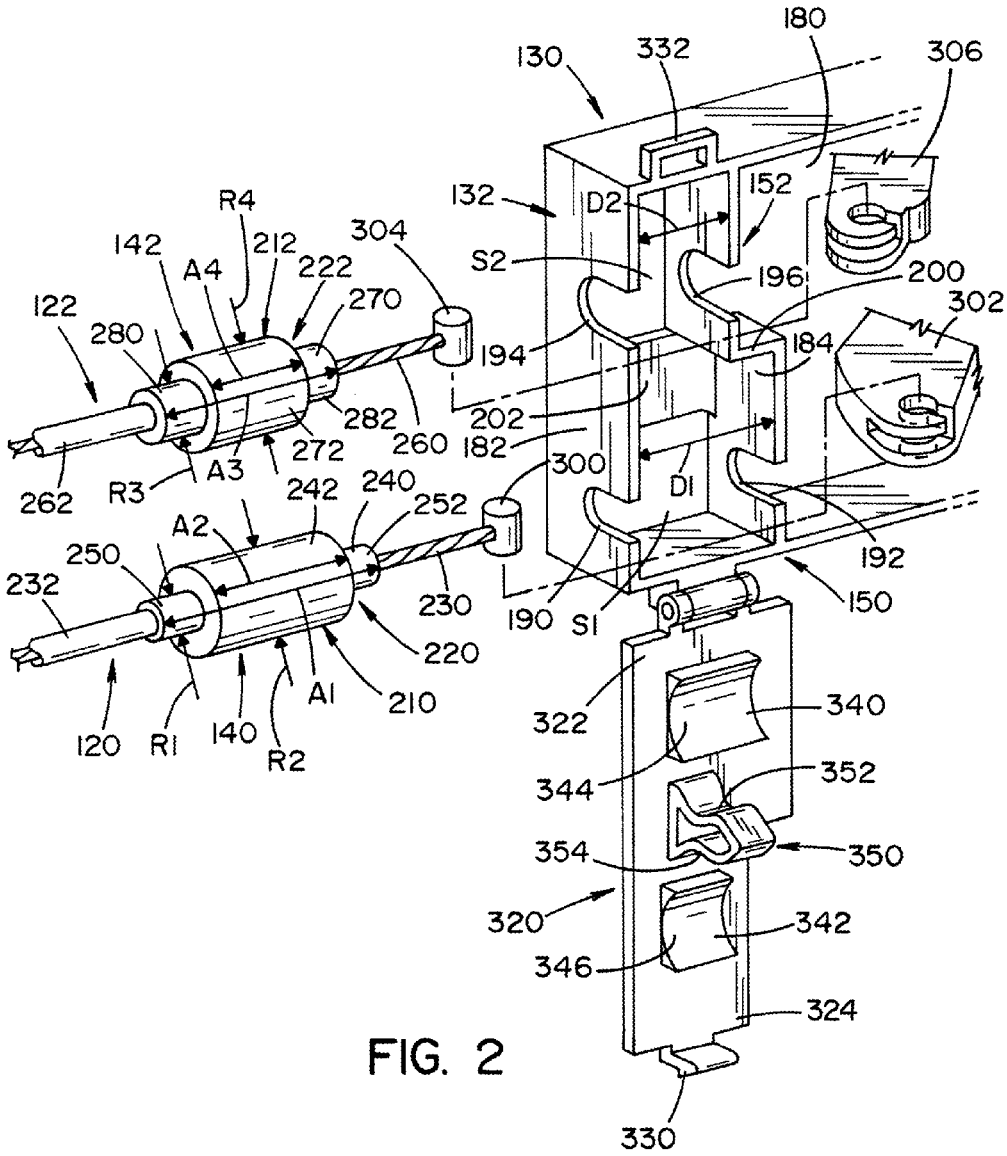
FIG. 2 is a partial schematic view of a cable support part of the handle device of FIG. 1 for mounting respective end portions of an open cable and a lock cable to a housing of the handle device.
Figure 3:
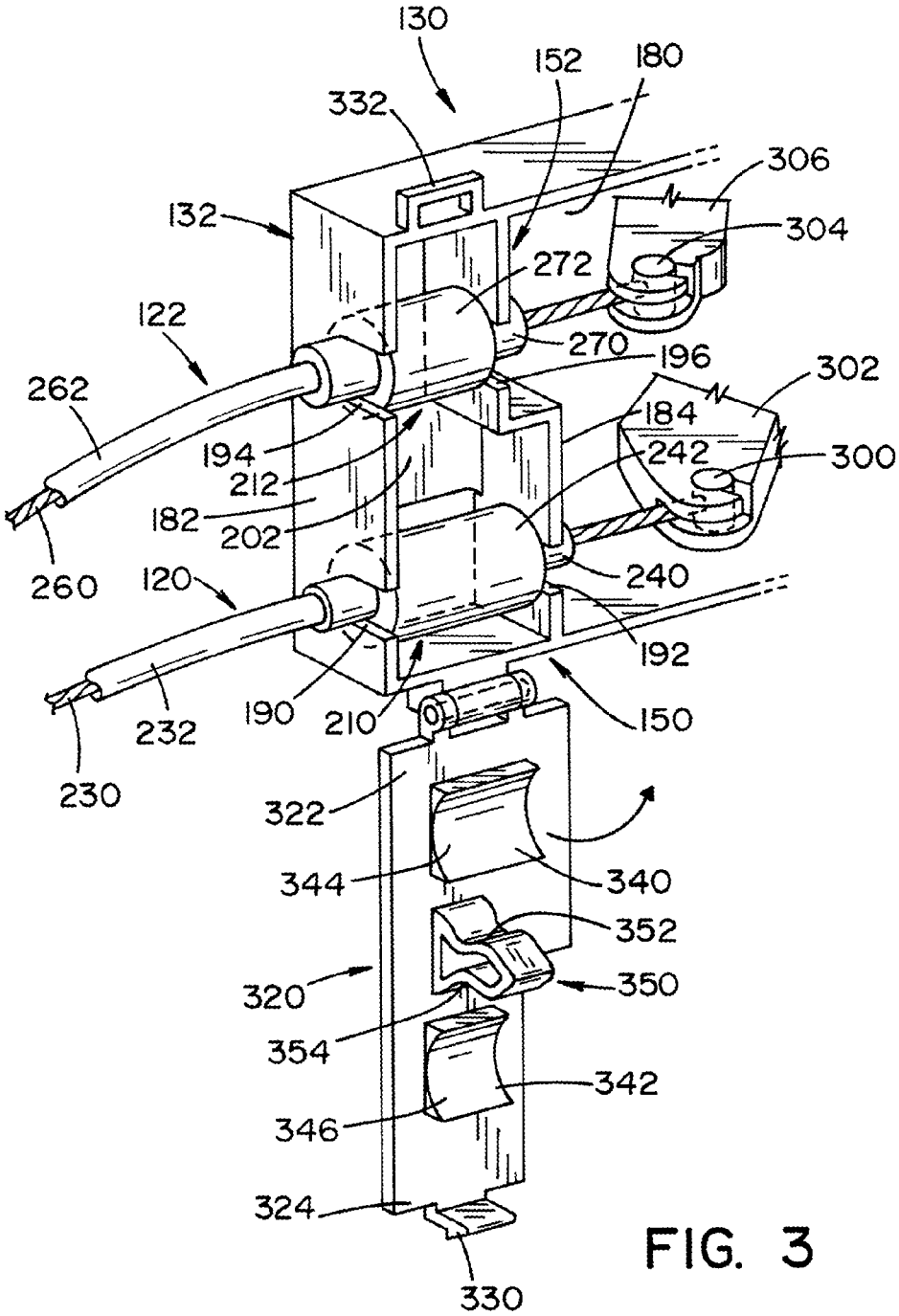
FIG. 3 is a partial schematic view of the end portions of the open and lock cable positioned in the cable support part of FIG. 2.
Figure 4:
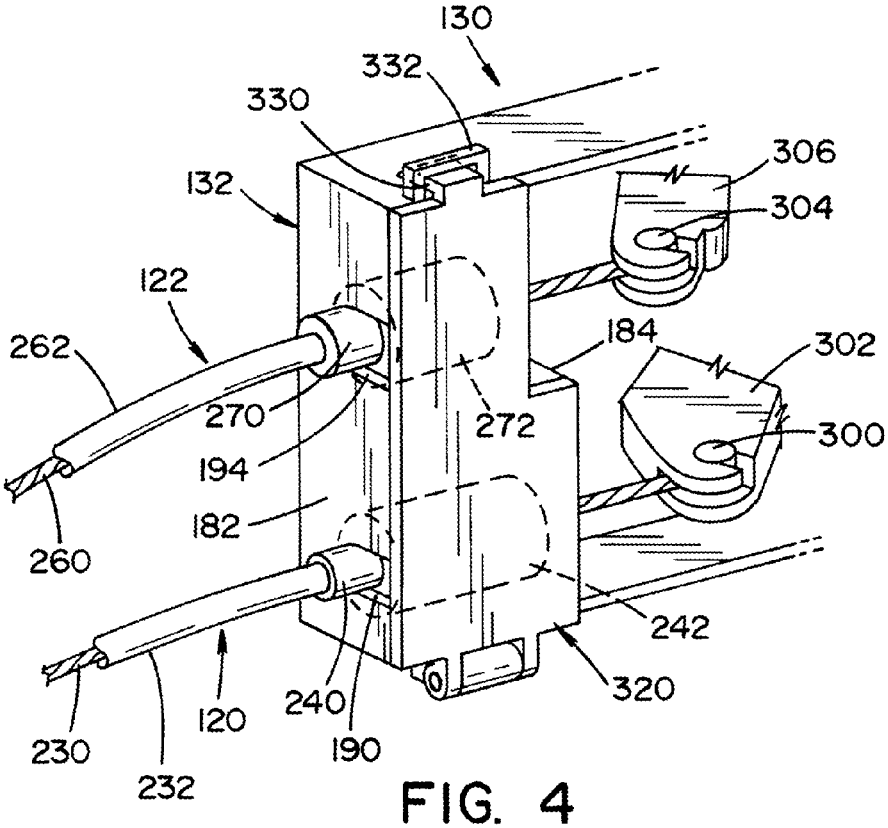
FIG. 4 is a partial schematic view of the end portions of the open and lock cable positioned secured in the cable support part of FIG. 2.

As shown in FIGS. 2-4, the handle housing 130 includes a cable support part 132 for supporting respective end portions 140, 142 of the open cable 120 and the lock cable 122. As will be discussed in greater detail below, the cable support part 132 defines a first space S1 for receiving the end portion 140 of the open cable 120, and a second space S2 for receiving the end portion 142 of the lock cable 122. The cable support part 132 is configured to prevent one of the end portion of the open cable 120 and the end portion of the lock cable 122 from being received in one of the first space and the second space. More particularly, the cable support part 132 is configured to prevent cable-drop off and includes a first portion 150 having a first configuration configured to only receive the end portion 140 of the open cable 120 and a second portion 152 having a second configuration configured to only receive the end portion 142 of the lock cable 122. At least one of the first configuration and the second configuration is too small to receive at least one of the end portion 140 of the open cable 120 and the end portion 142 of the lock cable 122.

With reference back to FIG. 1, the vehicle door handle device 102 can be operated from inside the door 100 to open the door 100 (a right vehicle door is illustrated). It should be appreciated that a door handle device attached to a left door (similar to the right door 100) not shown in the drawings is identical to the handle device 102. As indicated above, the handle device 102 is attached to the door panel 104 of the door 100 supported on the vehicle body 108. By actuating the operation handle 116, the door 100 is released from locking with the vehicle body. The door 100 further includes an outer panel 160 disposed toward the outside of the vehicle shown in FIGS. 2 and 4, the inner panel 104 attaches to the outer panel 160 toward the inside of the vehicle, an interior member 162 attached to the front surface of the inner panel 104 (the surface facing into the passenger compartment), and a door opening/closing device 166.

The door opening/closing device 166 includes an outer side door handle device (not shown) provided to the outer panel 160 of the door 100 and operated from the vehicle exterior, the door handle device 102 provided on the inner panel 104 of the door, the latching device linked to the operation handle 116 by the open cable 120 and also linked to the outer side door handle device, and the locking device linked to the lock knob 118 by the lock cable 122. The locking device 106 has a known configuration, including a lock mechanism 170 fixed to the inner panel 104. A striker (not shown) cooperates with the lock mechanism 170 in a known manner and is fixed to the vehicle body 108. As is well known, the locking device 106 locks when the lock cable 122 is moved relative to the lock mechanism 170 and unlocks when the lock cable 122 is moved relative to the lock knob 118, and the latching device is released when the open cable 120 of the door handle device 102 is moved relative to the door handle device.

The door handle device 102 comprises the inner handle housing 130 attached to the inner panel 104, the operation handle 116 and lock knob 118 movably attached to the handle housing 130, and the cable support part 132. As shown in FIGS. 2-4, the cable support part 132 is integrally formed with the handle housing 130. Thus, separate mounting devices for the open cable 120 and lock cable 122 are not required. The inner handle housing 130 includes a base wall 180. The cable support part 132 includes a first side wall 182 and a second side wall 184 spaced from the first side wall. The first side wall 182 can be an end wall of the housing 130 and the second side wall 184 can be an interior support wall of the housing 130. Each of the first and second side walls 182,184 is connected to and extends substantially perpendicular from the base wall 180. The first and second side walls 182,184 together with the base wall 180 define the first space S1 associated with the first portion 150 and the second space S2 associated with the second portion 152.

The first and second side walls 182,184 are configured to at least partially define the first and second portions 150,152 of the cable support part 132. Particularly, each of the first side wall 182 and the second side wall 184 includes a respective first recess or opening 190,192 and a respective second recess or opening 194,196. The first recess 190 of the first side wall 182 is aligned with and corresponds in size and shape to the first recess 192 provided in the second side wall 182. Similarly, the second recess 194 of the first side wall 182 is aligned with and corresponds in size and shape to the second recess 196 provided in the second side wall 184. As will be discussed below, the size and shape of the first recesses 190,192 and the second recesses 194,196 are dependent on the shape of the end portion 140,142 of the open cable 120 and lock cable 122.

As shown in FIGS. 2 and 3, the second side wall 184 includes an offset section 200, the offset section having one of the first recess 194 and second recess 196. In the depicted embodiment, the offset section 200 includes the second recess 196; although, this is not required. The offset section 200 provides for a first dimension D1 between the first side wall 182 and the second side wall 184 of the first portion 150 of the cable support part 132, and a second dimension D2 between the first side wall 182 and the second side wall 184 of the second portion 152 of the cable support part 132. In other words, the offset section 200 at least partially defines the first configuration of the first portion 150 and the second configuration of the second portion 152. As shown, the first dimension D1 is greater than the second dimension D2; although, this is not required. The cable support part 132 can further include a base wall 202. The base wall 202 is connected to the base wall 180 of the housing 130. The base wall 202 at least partially separates the first portion 150 and the second portion 152, and can provide strength and rigidity to the cable support part 132.

With continued reference to FIGS. 2 and 3, each of the first recesses 190,192 and second recesses 194,196 of the respective first side wall 182 and second side wall 184 are dimensioned to receive first and second elongated mounting members 210,212 fixed on the respective end portions 140,142 of the open cable 120 and lock cable 122. To prevent crossing of the first and second mounting members 210,212 during assembly of the handle device 102, the first mounting member 210 has at least one dimension different than a corresponding dimension of the second mounting member 212. For example, one of a lengthwise or widthwise dimension of the first mounting member 210 is different that the corresponding lengthwise or widthwise dimension of the second mounting member 212. In the depicted embodiment, each of the first and second elongated members 210,212 defines a step portion 220,222.

Particularly, the open cable 120 includes a cable inner portion 230, a cable outer portion or sheath 232 provided on the cable inner portion, and the step portion 220 fixed on the cable outer portion. The step portion 220 has a first member 240 and a second member 242 provided on the first member. As shown, each of the first and second members 240,242 are cylindrical shaped; although, this is not required. With a cylindrical configuration, an axial dimension (i.e., lengthwise dimension) A1 of the first member 240 is greater than the first dimension D1, and an axial dimension (i.e., lengthwise dimension) A2 of the second member 242 is approximately equal to or slightly less than the first dimension D1.

Similarly, the lock cable 122 includes a cable inner portion 260, a cable outer portion or sheath 262 provided on the cable inner portion, and the step portion 222 fixed on the cable outer portion. The step portion 222 has a first member 270 and a second member 272 provided on the first member. As shown, each of the first and second members 270,272 are cylindrical shaped; although, this is not required. With a cylindrical configuration, an axial dimension (i.e., lengthwise dimension) A3 of the first member 270 is greater than the second dimension D2, and an axial dimension (i.e., lengthwise dimension) A4 of the second member 272 is approximately equal to or slightly less than the second dimension D2. Depending on the offset section 200, the axial dimension A2,A4 of the second member 242,272 of the step portion 220,222 of one of the open cable 120 and the lock cable 122 is greater than the corresponding axial dimension of the second member 242,272 of the step portion of the other of the open cable 120 and lock cable 122. In the illustrated embodiment, because D1 is greater than D2, axial dimension A2 is greater than axial dimension A4.

The depicted step portion 220 further includes a radial dimension (i.e., widthwise dimension) R1 defined by the first member 240 and a radial dimension (i.e., widthwise dimension) R2 defined by the second member 242. The depicted step portion 222 further includes a radial dimension (i.e., widthwise dimension) R3 defined by the first member 270 and a radial dimension (i.e., widthwise dimension) R4 defined by the second member 272. As indicated previously, each first recess 190,192 of the first and second side walls 182,184 differs in size than each second recess 194,196 of the first and second side walls. As such, the radial dimension R1,R3 of the first member 240,270 of the step portion 220, 222 of one of the open cable 120 and the lock cable 122 is greater than the corresponding radial dimension of the first member 240,270 of the step portion of the other of the open cable 120 and lock cable 122. As depicted embodiment, the first recesses 190,192 are smaller in size than the second recesses 194,196, which allows radial dimension R1 to be less than radial dimension R3. The radial dimension R2 of the second member 242 can be approximately equal to the radial dimension R4 of the second member 272.

FIG. 3 depicts the first and second elongated mounting members 210,212 mounted to the first and second portions 150,152 of the cable support part 132. As shown, the end portions 250,252 of the first member 240 are received in the first recesses 190,192 of the respective first and second side walls 182,184, and the second member 242 is received in the space S1 of the first portion 150. The end portions 280,282 of the first member 270 are received in the second recesses 194,196 of the respective first and second side walls 182,184, and the second member 272 is received in the space S2 of the second portion 152. A barrel member 300 provided on the cable inner portion 230 of the open cable 120 is then mounted to a lever or grip 302 of the handle device 102, and a barrel member 304 provided on the cable inner portion 260 of the lock cable 122 is then mounted to a lever 306 of the lock knob 118 of the handle device. With the configuration of the cable support part 132 and the corresponding first and second elongated mounting members 210,212 provided on the end portions 140,142 of the open cable 120 and lock cable 122, a worker cannot cross the cables during assembly of the handle device 102.

As indicated above, the first and second elongated mounting members 210,212 define the step portions 220,222, which include the respective first members 240,270 and second members 242,272. It should be appreciated that the first members 240,270 are not required to assure proper assembly of the handle device 102. With this alternative embodiment, the first recesses 190,192 are sized to receive the cable outer portion 232 of the open cable 120, and the second recesses 194,196 are sized to receive the cable outer portion 262 of the lock cable 122. Further, it should be appreciated that alternative shapes for the step portions 220,222 are contemplated. For example, the step portions can be rectangular shaped.

With reference back to FIGS. 2-4, the cable support part 132 further includes a cap 320. The cap 320 has one end portion 322 hingedly connected to the inner handle housing 130 and the other end portion 324 releasably connected to the inner handle housing 130 via a locking member 330 which engages a receiving member 332 provided on the inner handle housing. The cap 320 secures the respective end portions 140,142 of the open cable 120 and the lock cable 122 in the cable support part 132 in a cap closed position. Specifically, in the depicted embodiment, the cap 320 includes at least one engagement member configured to engage the step portions 220,222 provided on the open cable 120 and lock cable 122 in the cap closed position. The at least one engagement member includes a first engagement member 340 and a second engagement member 342. Each of the first and second engagement members 340,342 includes a surface 344,346 shaped to matingly engage the respective second member 242,272 of each step portion 220,222 in the cap closed position. The cap 320 can further include a third engagement member 350 which is located between the first and second engagement members 340,342. The third engagement member 350 includes a first surface 352 facing the first engagement member 340 and a second surface 354 facing the second engagement member 342. Similar to surface 344,346, each surface 352,354 is shaped to matingly engage the respective second member 242,272 of each step portion 220,222 in the cap closed.

As is evident form the foregoing, the present disclosure provides the cable support part 132 which is integrally formed with the inner handle housing 130 and is configured to prevent cable drop-off. The cable support part 132 includes the first side wall 182 and the interior, second side wall 184 spaced from the first side wall. Appropriately shaped openings or recesses 190,192,194,196 are provided in the cable support part 132. The recesses are dimensioned to receive step portions 220,222 of the respective open cable 120 and lock cable 122. End portions of the step portion 220,222 of each respective cable 120,122 are positioned in the aligned recesses provided in the cable support part 132. The cap 320 is hingedly connected to the inner handle housing 130. The cap 320 includes engagement members 340,342,350 which, in the cap closed position, engage the step portions 220,222 provided the open and lock cables 120,122. An end of the cap 320 includes the locking member 330 which engages the receiving member 332 provided on the inner handle housing 130. With such a cable support part 132, separate mounting devices are not required and cable drop-off is prevented.

According to the present disclosure, the cable support part 132 is configured to prevent cable-drop off and includes the first portion 150 having a first configuration for only receiving the end portion 140 of the open cable 120 and the second portion 152 having a second configuration for only receiving the end portion 142 of the lock cable 122. The end portion 140 of the open cable 120 is configured to be matingly received in the first space S1 and the end portion 142 of the lock cable 122 is configured to be matingly received in the second space S2. In the illustrated embodiment, the second space S2 is too small to receive the end portion 140 of the open cable 120. Also, the first space S1 is too large to snugly receive the end portion 142 of the lock cable 122, i.e., the axial dimension A4 is less than D1.

The present disclosure further provides a method of securing the open cable 120 and the lock cable 122 to the inner handle housing 130 of the vehicle door handle device 102. As indicated above, the door handle device 102 is adapted to be attached to the door panel 104 for operating the door latching device and the door locking device 106. The method comprises providing the cable support part 132 on the inner handle housing 130 for supporting respective end portions 140,142 of the open cable 120 and the lock cable 122. The cable support part 132 includes the first portion 150 having the first configuration and the second portion 152 have the second configuration different than the first configuration. The method further comprises providing the first elongated mounting member 210 fixed on the end portion 140 of the open cable 120, and providing the second elongated mounting member 212 fixed on the end portion 142 of the lock cable 122. The first mounting member 210 is mounted on the first portion 150 of the cable support part 132, and the second mounting member 212 is mounted on the second portion 152 of the cable support part.

The method of securing the open cable 120 and lock cable 122 to the housing 130 further comprises providing the first elongated mounting member 210 with at least one dimension different than a corresponding dimension of the second cylindrical member 212. Particularly, the first elongated mounting member 210 can be provided with a radial or widthwise dimension and an axial or lengthwise dimension different than a corresponding radial or widthwise dimension and a corresponding axial or lengthwise dimension of the second elongated mounting member 212. A lid is provided on the inner handle housing 130 for securing the first and second mounting members 210,212 on the respective first and second portions 150,152 of the cable support part 132.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A vehicle door handle device for attaching to a door panel for operating a door latching device and a door locking device, the door handle device comprising:

an operation handle for operating the latching device to unlatch and open the door;

a lock knob for operating the locking device to lock and unlock the door;

an open cable for linking the operation handle to the latching device;

a lock cable for linking the lock knob to the locking device; and an inner handle housing for housing the operation handle and the lock knob, the handle housing including a cable support part having a first side wall and a second side wall, the second side wall including a first section and a second section offset inwardly from the first section toward the first side wall, the first side wall together with the first section of the second side wall defining a first portion of the cable support part configured to only receive the end portion of the open cable, the first side wall together with the second section of the second side wall defining a second portion of the cable support part configured to only receive the end portion of the lock cable, wherein the cable support part is configured to prevent the end portion of the open cable from being separately received in the second portion and the end portion of the lock cable from being separately received in the first portion.

2. The door handle device of claim 1, wherein the cable support part is integrally formed with the inner handle housing.

3. The door handle device of claim 1, wherein the inner handle housing includes a base wall, each of the first and second side walls of the cable support part being connected to and extending substantially perpendicular from the base wall.

4. The door handle device of claim 1, wherein each of the first side wall and the second side wall includes a first recess and a second recess, the first recess of the first side wall being aligned with and corresponding in size and shape to the first recess provided in the second side wall, and the second recess of the first side wall being aligned with and corresponding in size and shape to the second recess provided in the second side wall.

5. The door handle device of claim 4, wherein the offset second section of the second side wall has one of the first and second recesses.

6. The door handle device of claim 5, wherein each of the first and second recesses of the first and second side walls are dimensioned to receive elongated step portions fixed on the respective end portions of the open cable and lock cable.

7. The door handle device of claim 6, wherein each first recess of the first and second side walls differs in size than each second recess of the first and second side walls.

8. The door handle device of claim 6, wherein each of the open cable and the lock cable includes a cable inner portion, a cable outer portion provided on the cable inner portion, and the step portion provided on the cable outer portion, each step portion having a first member and a second member provided on the first member, a lengthwise dimension of the second member of the step portion of one of the open cable and the lock cable being greater than a corresponding lengthwise dimension of the second member of the step portion of the other of the open cable and lock cable.

9. The door handle device of claim 8, wherein a widthwise dimension of the first member of the step portion of one of the open cable and the lock cable being greater than a corresponding widthwise dimension of the first member of le step portion of the other of the open cable and lock cable.

10. The door handle device of claim 6, further including a cap having one end portion hingedly connected to the inner handle housing and the other end portion releasably connected to the inner handle housing, the cap securing the respective end portions of the open cable and the lock cable in the cable support part in a cap closed position.

11. The door handle device of claim 10, wherein the cap includes at least one engagement member configured to engage the step portions provided on the open cable and lock cable in the cap closed position.

12. The door handle device of claim 10, wherein the other end portion of the cap includes a locking member which engages a receiving member provided on the inner handle housing.

13. A vehicle door handle device for attaching to a door panel for operating a door latching device and a door locking device, the handle device comprising:

a lock knob for operating the locking device to lock and unlock the door;

an operation handle for operating the latching device to unlatch and open the door;

a lock cable for linking the lock knob to the locking device;

an open cable for linking the operation handle to the latching device;

an inner handle housing for receiving the operation handle and lock knob, the handle housing including an integral cable support part for supporting respective end portions of the open cable and the locking cable, the cable support part including a first side wall and a second side wall which is offset from the first side wall, the first and second side walls being configured to define first and second portions of the cable support part, the first portion having a first configuration for receiving the end portion of the open cable and the second portion having a second configuration for receiving the end portion of the lock cable, wherein at least one of the first configuration and the second configuration is too small to receive at least one of the end portion of the open cable and the end portion of the lock cable; and a cap for securing the respective end portions of the open cable and the lock cable in the cable support part in a cap closed position, the cap including an outwardly extending engagement member configured to both be positioned between the respective end portions of the open cable and the lock cable, and engage both the respective first and second elongated members provided on the open cable and lock cable in the cap closed position.

14. The vehicle door handle device of claim 13, wherein a first elongated mounting member is fixed on the end portion of the open cable, and a second elongated mounting member is fixed on the end portion of the lock cable, the first elongated mounting member having at least one dimension different than a corresponding dimension of the second elongated mounting member.

15. The vehicle door handle device of claim 14, wherein each of the first side wall and the second side wall includes a first recess and a second recess, the first recess of the first side wall being aligned with and corresponding in size and shape to the first recess provided in the second side wall, and the second recess of the first side wall being aligned with and corresponding in size and shape to the second recess provided in the second side wall, the first recesses receiving the first elongated mounting member and the second recesses receiving the second elongated mounting member.

16. The vehicle door handle device of claim 13, wherein the engagement member includes a first surface and a second surface opposite the first surface, the first surface engaging the first elongated member provided on the open cable in the cap dosed position, the second surface engaging the second elongated member provided on the lock cable in the cap dosed position.

17. The vehicle door handle device of claim 13, wherein the cap further includes a second engagement member and a third engagement member, the second engagement member configured to only engage the first elongated member provided on the open cable in the cap dosed portion, the third engagement member configured to engage only the second elongated member provided on the lock cable in the cap dosed position.

* * * * *